United States Patent [19]

Brisco

[11] Patent Number: 4,958,445

[45] Date of Patent: Sep. 25, 1990

[54] WALKING SOLE ACCESSORY FOR A SKI BOOT

[76] Inventor: Gregory J. Brisco, 106 Woodlyn Ave. #3, Glenside, Pa. 19038

[21] Appl. No.: 375,202

[22] Filed: Jun. 30, 1989

[51] Int. Cl.[5] ..... A43B 5/04

[52] U.S. Cl. ..... 36/7.5; 36/117; 36/132

[58] Field of Search ..... 36/7.5, 7.6, 135, 110

[56] References Cited

U.S. PATENT DOCUMENTS

| | | | |
|---|---|---|---|
| 4,199,880 | 4/1980 | Frey | 36/7.5 X |
| 4,228,602 | 10/1980 | Groves | 36/7.6 X |
| 4,843,672 | 7/1989 | Fasse | 36/7.5 X |

FOREIGN PATENT DOCUMENTS

| | | | |
|---|---|---|---|
| 485876 | 12/1927 | Fed. Rep. of Germany | 36/7.5 |

*Primary Examiner*—Paul T. Sewell
*Assistant Examiner*—Andrew Meyers
*Attorney, Agent, or Firm*—Fishman, Dionne & Cantor

[57] ABSTRACT

A walking sole accessory for a ski boot is disclosed. The accessory includes a sole having a convex bottom surface and means for attaching the sole to a ski boot. The attachment means are operated manually and adjust to accommodate a wide range of boot sizes. The walking sole accessory allows a ski boot wearer to enjoy a comfortable walking gait.

4 Claims, 1 Drawing Sheet

WALKING SOLE ACCESSORY FOR A SKI BOOT

Technical Field

The present invention relates to sporting equipment and more particularly to equipment for skiing.

Background

Downhill ski boots are designed to enable a skier to exercise positive control over the action of his skis. Accordingly, such boots have flat rigid soles for engagement with ski bindings and provide rigid ankle support. It is difficult to walk while wearing ski boots, as the combination of rigid ankle support and an inflexible flat sole prevents a smooth transfer of weight from the heel to the ball of the foot. A ski boot wearer is thus forced to walk with an awkward and uncomfortable gait.

Summary of the Invention

A walking sole accessory for a ski boot is disclosed. The accessory comprises a sole and gripping means for attaching the sole to a ski boot. The sole longitudinalty extends from a toe end to a heel end and has a convex bottom surface, a distal side panel, a medial side panel, and a flat top surface for engaging the bottom surface of a ski boot. The sole has a non-uniform thickness between the flat top surface and the convex bottom surface wherein the thickness is dependent upon longitudinal distance from the toe end of the sole. A first gripping means is rigidly mounted on the top surface of the sole. A second boot gripping means is slideably mounted on the top surface of the sole. A resilient means for biasing the second boot gripping means towards the first gripping means is provided, as well as a means for releasably securing the second boot gripping means to the sole. The convex bottom surface of sole accessory of the present invention allows a ski boot wearer to walk comfortably and the boot gripping means allow rapid manual installation and removal of the sole accessory. The sole accessory of the present invention adjusts automatically to accommodate a wide range of ski boot sizes.

Description of the Preferred Embodiment

Figure 2:
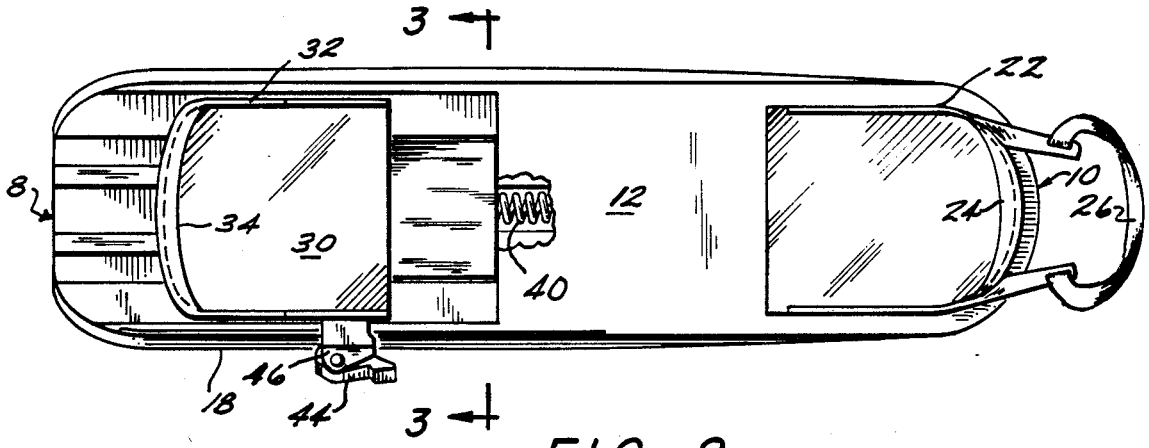
FIG. 2 shows a top view of the sole accessory of the present invention.
Figure 1:
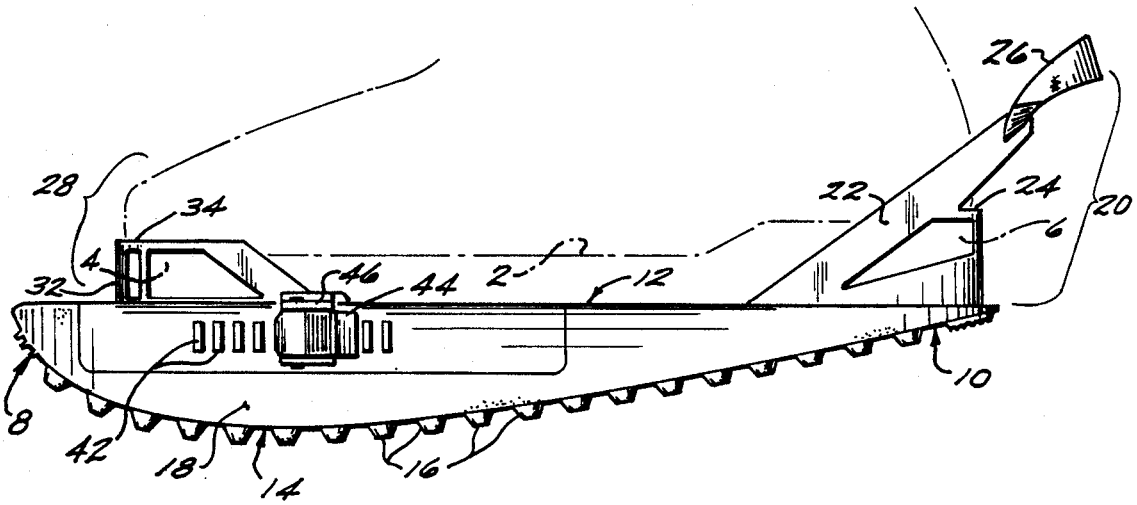
FIG. 1 shows a side view of the sole accessory of the present invention.

FIG. 1 shows a side view of a walking sole accessory of the present invention mounted on the sole of a typical ski boot. The ski boot has a boot sole 2. The boot sole 2 has a toe binding lip 4 and a heel binding lip 6, each for engagement with ski bindings.

The walking sole accessory extends from a toe end 8 to a heel end 10. The walking sole has a flat top surface 12 for engagement with the boot sole 2. The walking sole has a convex bottom surface 14 to allow the user to walk with a more natural heel-to-toe gait than is possible in the flat soled ski boot. The bottom surface 14 extends continuously from the toe end 8 to the heel end 10. A plurality of lugs 16 protrude from the bottom surface 14 of the walking sole. The lugs 16 facilitate obtaining a purchase on a substrate, e.g.: gravel, snow, etc. The walking sole has an outer side panel 18 and an opposite inner side panel (not shown), each extending between the flat top surface 12 and the convex bottom surface 14 of the walking sole.

The combination of a flat top surface 12 and a convex bottom surface 14 result in the sole having a nonuniform thickness. The sole may be characterized as having three regions. A wedge region increases in thickness as it extends from the heel end 10 of the sole for a distance between about one third and one half the distance between the head end 10 and the toe end 8 of the sole. In the wedge region the bottom sole 14 extends at and angle between 15 and 30 degrees relative to the top sole 12. The wedge region blends into a gently curved region. The thickness between the bottom sole 14 and the top sole 12 is greatest in the gently curved region. The gently curved region reaches maximum thickness at distance from the heel end 10 of the sole that is equal to what two thirds of the distance from the heel end 10 to the toe end 8. The gently curved region blends into a shaply curved region which extends from the gently curved region to the toe end 8 of the sole. As noted above, the shape of the sole of the present invention allows a more comfortable gait. When the wearer takes a step, the sole strikes the ground at the heel end 10, rolls forward along the wedge region, along the gently curved region wherein the heel is elevated, and finally along the sharply curved region to the toe end 8 for push off.

A heel retaining member 20 is rigidly mounted on the top surface 12 of the walking sole near the heel end 10 of the walking sole. The heel retaining member 20 includes a support bracket 22, a heel flange 24 for engaging the heel binding lip 6 of the ski boot sole 2 and a handle 26 to aid in attaching and removing the walking sole accessory.

Figure 3:
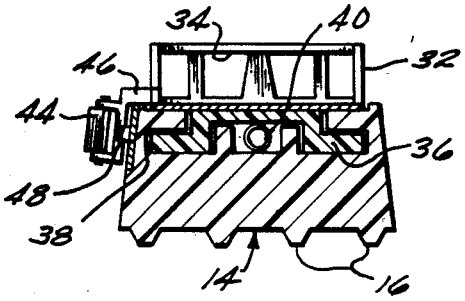
FIG. 3 shows a sectional view along line 3—3 of FIG. 2.

A toe retaining member 28 is slidably mounted on the top surface 12 of the sole near the toe end 8 of the sole. The toe retaining member 28 includes a toe platform 30, a support bracket 32, a toe flange 34 for engaging the toe binding lip 4 of the ski boot sole 2 and a mounting flange 36. Referring to FIG. 3, the mounting flange 36 of the toe retaining member 28 slidably engages mounting grooves 38 in the walking sole. The toe retaining member 28 is urged toward the heel end 10 of the walking sole accessory by a spring 40.

A row of locking teeth 42, shown in FIG. 1 are disposed along the distal side panel 18 of the sole near the toe end 8 of the sole. A cam shaped locking lever 44 is rotatably secured to the second flange by a bracket 46. Referring to FIG. 3, the locking lever 44 has a tab 48 for releasably engaging the locking teeth 44 on the sole. The locking lever 44 has a locked position in which the tab 48 engages the locking teeth 42 to prevent axial movement of the toe retaining member 28 relative to the sole. The locking lever 44 may be rotated so that the tab 48 disengages the locking teeth 42 to allow axial movement of the toe retaining member 28 relative to the sole.

The walking sole accessory of the present invention may be constructed from any strong, light-weight, water resistant material which provides tough mechanical properties within the temperature range of potential use. Polymeric materials, e.g.: polypropylene, are preferred.

The walking sole accessory of the present invention may be easily attached and removed from a ski boot. To attach the sole accessory of the present invention, the user rotates the locking lever 44 to disengage the locking tab 48 from the locking teeth 42, engages the toe binding lip 4 of a ski boot with the toe retaining member 28, pushes the toe retaining member 28 toward the toe end 8 of the sole, places the ski boot sole 2 on the flat top surface 12 of the sole accessory, and allows the spring tension to urge the heel binding lip 6 of the ski boot into the heel retaining member 20. Once the toe binding lip 4 and the heel binding lip 6 of the ski boot are engaged with the flanges 24 and 34 of the toe and heel retaining members 20 and 28, the locking lever 44 is rotated so that the locking tab 48 engages the locking teeth 42 on the sole. The sole accessory may be easily removed from the ski boot by reversing the above sequence.

Installation and removal of the sole accessory may be accomplised without the use of any tools. The locking lever may be manually operated while wearing gloves or mittens. It will be further appreciated in that the sole accessory of the present invention adjusts automatically to accommodate a wide range of ski boot sizes.

What is claimed is:

1. A walking sole accessory for a ski boot, comprising:

a sole longitudinally extending from a toe end to a heel end and having a convex bottom surface, an outer side panel, an inner side panel, and a flat top surface for engaging a bottom surface of a ski boot, said sole having a nonuniform thickness between the flat top surface and the convex bottom surface wherein the thickness is dependent upon longitudinal distance from the toe end of the sole, a row of locking teeth disposed along the outer side panel of the sole and near the toe end of the sole, a row of locking teeth disposed along the outer side panel of the sole and near the toe end of the sole, first boot gripping means rigidly mounted on the top surface of the sole, second boot gripping means slideably mounted on the top surface of the sole, resilient means for biasing the second boot gripping means towards the first gripping means, a locking lever rotatably mounted on the second gripping means and including a projection for releasably engaging the locking teeth.

2. The accessory of claim 1, wherein the thickness between the top surface and the bottom surface is greatest at a distance from the toe end of the sole that is equal to about one third of the distance between the toe end and the heel end of the sole and is minimal at the toe end and the heel end of the sole.

3. The accessory of claim 1, further comprising a plurality of lugs protruding from the bottom surface of the sole.

4. The accessory of claim 1, wherein the first gripping means comprises a flange for engaging a heel binding lip of a ski boot and the second boot gripping means comprises a flange for engaging a toe binding lip of a ski boot.

* * * * *